US008528647B2

(12) United States Patent
Guesnon et al.

(10) Patent No.: US 8,528,647 B2
(45) Date of Patent: Sep. 10, 2013

(54) RISER PIPE WITH RIGID AUXILIARY LINES ASSEMBLED BY PINS

(75) Inventors: Jean Guesnon, Chatou (FR); Gérard Papon, Les Essarts le Roi (FR); Emmanuel Persent, Croissy sur Seine (FR)

(73) Assignee: IFP Energies Nouvelles, Rueil Malmaison (FR)

( * ) Notice: Subject to any disclaimer, the term of this patent is extended or adjusted under 35 U.S.C. 154(b) by 249 days.

(21) Appl. No.: 12/888,477

(22) Filed: Sep. 23, 2010

(65) Prior Publication Data

US 2011/0073315 A1 Mar. 31, 2011

(30) Foreign Application Priority Data

Sep. 28, 2009 (FR) ..... 09 04617

(51) Int. Cl.
*E21B 17/01* (2006.01)
*E21B 33/038* (2006.01)

(52) U.S. Cl.
USPC ..... 166/367; 166/338; 166/344; 166/352; 166/360; 166/85.1; 285/124.1; 285/391; 285/402; 405/170; 405/224.2

(58) Field of Classification Search
USPC ..... 166/367, 338, 344, 351, 352, 360, 166/378–380, 85.1; 285/124.1–124.4, 391, 285/399, 401, 402, 405; 405/169, 170, 224.2–224.4; 403/348, 349
See application file for complete search history.

(56) References Cited

U.S. PATENT DOCUMENTS

| | | | | |
|---|---|---|---|---|
| 4,097,069 | A * | 6/1978 | Morrill | 285/84 |
| 4,280,719 | A * | 7/1981 | Daniel et al. | 285/90 |
| 4,330,140 | A * | 5/1982 | Hampton | 285/39 |
| 4,491,346 | A * | 1/1985 | Walker | 285/18 |
| 4,496,173 | A * | 1/1985 | Roche et al. | 285/24 |
| 4,550,936 | A * | 11/1985 | Haeber et al. | 285/26 |
| 4,573,714 | A * | 3/1986 | Sweeney | 285/363 |
| 5,441,311 | A * | 8/1995 | Watkins | 285/18 |
| 5,634,671 | A * | 6/1997 | Watkins | 285/18 |
| 5,657,823 | A * | 8/1997 | Kogure et al. | 166/340 |
| 5,992,893 | A * | 11/1999 | Watkins | 285/18 |
| 6,401,825 | B1 * | 6/2002 | Woodrow | 166/350 |
| 6,415,867 | B1 * | 7/2002 | Deul et al. | 166/367 |
| 6,419,277 | B1 * | 7/2002 | Reynolds | 285/123.1 |
| 6,615,922 | B2 * | 9/2003 | Deul et al. | 166/367 |

(Continued)

FOREIGN PATENT DOCUMENTS

| | | | |
|---|---|---|---|
| DE | 28 33 866 | A1 | 2/1980 |
| FR | 2 432 672 | | 2/1980 |
| FR | 2 464 426 | | 3/1981 |
| FR | 2 526 517 | | 11/1983 |
| FR | 2 557 194 | A1 | 6/1985 |
| FR | 2 799 789 | A1 | 4/2001 |
| FR | 2 828 121 | A1 | 2/2003 |
| FR | 2 828 262 | A1 | 2/2003 |
| FR | 2 891 578 | A1 | 4/2007 |
| WO | WO 2007/039688 | A1 | 4/2007 |

OTHER PUBLICATIONS

PCT/FR2006/002295 International Search Report.

*Primary Examiner* — Matthew Buck
(74) *Attorney, Agent, or Firm* — Antonelli, Terry, Stout & Krause, LLP.

(57) ABSTRACT

The invention relates to a riser pipe section (1) comprising a main tube (2), at least one auxiliary line element (3) arranged substantially parallel to said tube (2), the ends of the main tube comprising connection means allowing longitudinal stresses to be transmitted and the ends of the auxiliary line element comprising linking means allowing longitudinal stresses to be transmitted, said linking means comprising at least one locking pin (14).

19 Claims, 4 Drawing Sheets

(56) References Cited

U.S. PATENT DOCUMENTS

| | | | | |
|---|---|---|---|---|
| 6,679,472 | B2 * | 1/2004 | Baugh | 251/62 |
| 7,331,395 | B2 * | 2/2008 | Fraser et al. | 166/345 |
| 7,337,848 | B2 * | 3/2008 | Fraser et al. | 166/345 |
| 7,341,281 | B2 * | 3/2008 | Guesnon et al. | 285/81 |
| 7,347,455 | B1 * | 3/2008 | Taquino | 285/124.1 |
| 7,762,337 | B2 * | 7/2010 | Papon et al. | 166/345 |
| 7,913,767 | B2 * | 3/2011 | Larson et al. | 166/380 |
| 8,037,939 | B2 * | 10/2011 | Poirette et al. | 166/367 |
| 2005/0206163 | A1 * | 9/2005 | Guesnon et al. | 285/402 |
| 2009/0050330 | A1 * | 2/2009 | Papon et al. | 166/367 |
| 2009/0166043 | A1 * | 7/2009 | Poirette et al. | 166/367 |
| 2012/0037377 | A1 * | 2/2012 | Walker | 166/345 |

* cited by examiner

RISER PIPE WITH RIGID AUXILIARY LINES ASSEMBLED BY PINS

FIELD OF THE INVENTION

The present invention relates to the field of very deep sea drilling and oil reservoir development. It concerns a riser pipe element comprising at least one line, or rigid auxiliary line, i.e, which can transmit tensional stresses between the top and the bottom of the riser.

BACKGROUND OF THE INVENTION

A drilling riser is made up of an assembly of tubular elements whose length generally ranges between 15 and 25 m, assembled by connectors. The weight of these risers borne by an offshore platform can be very great, which requires suspension means of very high capacity at the surface and suitable dimensions for the main tube and the connection fittings.

So far, the auxiliary lines: kill lines, choke lines, booster lines and hydraulic lines are arranged around the main tube and they comprise insertable fittings fastened to the riser element connectors in such a way that these high-pressure lines can allow a longitudinal relative displacement between two successive line elements, without any disconnection possibility however. Owing to these elements mounted sliding into one another, the lines intended to allow high-pressure circulation of an effluent coming from the well or from the surface cannot take part in the longitudinal mechanical strength of the structure consisting of the entire riser.

Now, in the perspective of drilling at water depths that can reach 3500 m or more, the dead weight of the auxiliary lines becomes very penalizing. This phenomenon is increased by the fact that, for the same maximum working pressure, the length of these lines requires a larger inside diameter considering the necessity to limit pressure drops.

Document FR-2,799,789 aims to involve the auxiliary lines, kill lines, choke lines, booster lines or hydraulic lines, in the longitudinal mechanical strength of the riser. According to this document, a riser pipe element (commonly referred to as joint or section) comprises a main tube, connection means at both ends, at least one auxiliary line length arranged substantially parallel to the main tube. The auxiliary line length is secured by both ends to the connection means of the main tube so that the longitudinal mechanical stresses undergone by the connection means are distributed within the tube and the line.

One difficulty in achieving the riser according to document FR-2,799,789 lies in the means for fastening the auxiliary line length to the main tube. The tensional stresses undergone by the auxiliary line length are transmitted by these fastening means. Assembly and building constraints require a minimum distance between the axis of the main tube and the axis of the auxiliary line. This distance acts as a lever arm for the tensional stresses transmitted to the auxiliary line. As a result of the tensional stresses associated with the lever arm, the fastening means are subject to flexural deformations that can hinder smooth operation of the riser or require penalizing mechanical designs.

The present invention provides a riser built according to an alternative principle to the one disclosed by document FR-2,799,789. According to the present invention, the auxiliary lines as a whole take part, jointly with the main tube, in the taking up of the longitudinal stresses applied to the riser.

Document WO-2007/039,688 describes linking means between the auxiliary lines according to the principle of connectors coaxial to said auxiliary lines, of bayonet locking system or screw nut type. However, these systems notably have the drawback of a relatively large overall diameter, which adds to the diameter of the connector of the main line, considering that the resistance elements have to be arranged concentrically to the fluid passage.

SUMMARY OF THE INVENTION

The present invention thus relates to a riser section comprising a main tube, at least one auxiliary line element arranged substantially parallel to said tube, the ends of the main tube comprising connection means allowing longitudinal stresses to be transmitted and the ends of the auxiliary line element comprising linking means allowing longitudinal stresses to be transmitted. The linking means comprise at least one pin and a bore cooperating with one another so as to form an assembly, and the axis of the pin is parallel to the axis of the auxiliary line and non-merging.

According to the invention, the riser section can comprise two flanges arranged at each end of the auxiliary line element, one of the flanges carrying said pins, the other flange carrying said bores.

The flanges can have the shape of a crown concentric to the main tube, of a crown portion or of a rectangular plate.

The linking means can comprise two pins arranged on either side of the auxiliary line element on a circle centred on the axis of the riser.

The assembly can consist of a bayonet locking system or of a bolt locking system.

The auxiliary line element can be secured to said main tube by at least one of said flanges.

The connection means of the main tube can consist of a bayonet locking system.

The pins of the linking means can comprise a rotating locking element and a synchronization means, and rotation of the synchronization means causes rotation of the locking element. Alternatively, the connection means can comprise a first rotating locking element, wherein the pins of the linking means comprise a second rotating locking means, and rotation of the first locking element causes rotation of the second locking element.

The main tube can be a steel tube hooped by composite strips. The auxiliary line element can consist of steel tubes hooped by composite strips. The composite strips can comprise glass, carbon or aramid fibers coated with a polymer matrix.

Alternatively, the auxiliary line element can be made of a material selected from the list consisting of a composite material comprising reinforcing fibers coated with a polymer matrix, an aluminium alloy, a titanium alloy.

The present invention also describes a riser comprising at least two riser sections according to the invention, assembled end to end, wherein an auxiliary line element of a section transmits longitudinal stresses to the auxiliary line element of the other section to which it is assembled by means of flanges holding the ends of the auxiliary line around the main tube of said section, said flanges being secured by pins arranged parallel to said auxiliary line.

BRIEF DESCRIPTION OF THE FIGURES

Other features and advantages of the invention will be clear from reading the description hereafter, with reference to the accompanying figures wherein.

DETAILED DESCRIPTION

Figure 1:
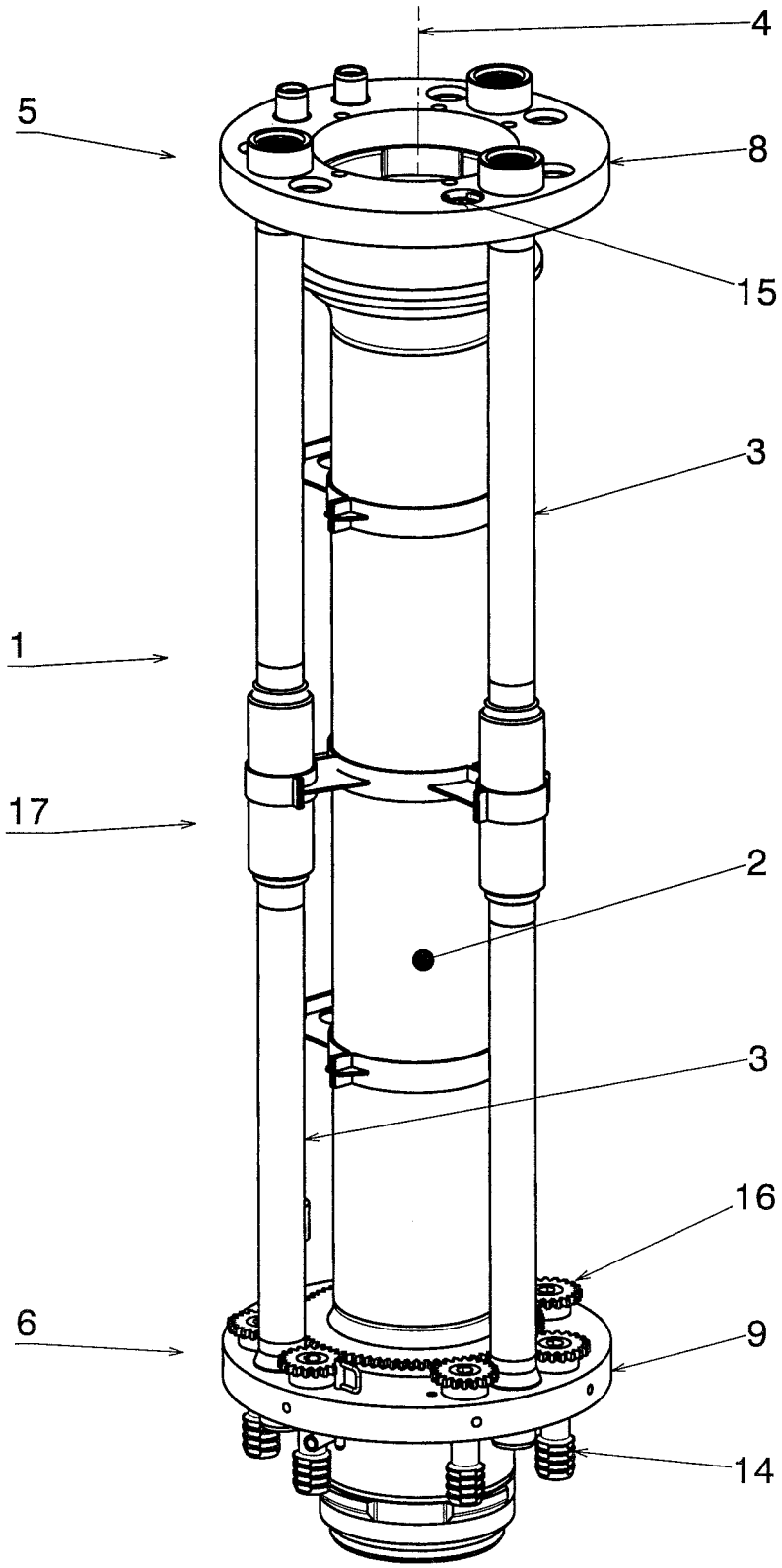
FIG. 1 shows a riser section equipped with linking means according to the invention.

FIG. 1 shows a section 1 of a riser. Section 1 is provided, at one end thereof, with female connection means 5 and, at the other end, with male connection means 6. To form a riser, several sections 1 are assembled end to end using connection means 5 and 6.

Riser section 1 comprises a main tube element 2 whose axis 4 makes up the axis of the riser. The auxiliary lines are arranged parallel to axis 4 of the riser so as to be integrated in the main tube. Reference numbers 3 designate the unit elements of the auxiliary lines. The lengths of elements 3 are substantially equal to the length of main tube element 2. There is at least one line 3 arranged on the periphery of main tube 2. The lines are preferably distributed symmetrically around tube 2 so as to balance the load transfer of the riser. The lines referred to as kill line and choke line are used to provide well safety during control procedures relative to the inflow of fluids under pressure in the well. The line referred to as booster line allows drilling fluid to be injected at the bottom of the riser. One or more hydraulic lines allow to transmit to the sea bottom the hydraulic power required for controlling all the preventers, commonly referred to as BOP stack, mounted on the subsea wellhead.

The female 5 and male 6 connection means consist of several connectors: main tube element 2 and each auxiliary line element 3 are each provided with mechanical connection means. These mechanical connectors allow to transmit longitudinal stresses from one element to the next. For example, the connectors between main tube sections can be of the type described in documents FR-2,432,672, FR-2,464,426, FR-2,526,517 and FR-2,557,194. Such a connector comprises a male tubular element and a female tubular element that fit into one another and have an axial shoulder for longitudinal positioning of the male tubular element with respect to the female tubular element. Each connector also comprises a locking ring mounted mobile in rotation on one or the other of the male and female tubular elements, The ring comprises studs that cooperate with the studs secured to the other tubular element so as to form a bayonet joint. The connection means are described more in detail in FIG. 2.

In FIG. 1, auxiliary lines 3 are positioned around main tube 2 of the riser by end flanges 8 and 9. These flanges, shown here in form of crown-shaped elements concentric to the connection means of the main tube, have two main purposes:

hold and position the auxiliary lines around the section and the riser, and mechanical assembly of the linking means between auxiliary lines of two consecutive sections, so as to transmit the longitudinal stresses from one auxiliary line section to another, consecutive one.

The flanges therefore carry pins 14 on one of the flanges, said pins cooperate with bores 15 provided on the other flange of the riser section. Pins 14 and bores 15 are provided with teeth over one (or more) angular sector(s) so that, in a given angular position of the pin with respect to the bore, the pin can enter the bore by simple translation. Once in place, the pin achieves locking through angular rotation. It can be noted that this lock principle is similar to that of the connection locking of the main tube.

According to the invention, the flanges can have various shapes, for example a crown concentric to the connection means of the main tube, and the crown can be split into several sectors, a crown portion, a rectangular or triangular plate.

Locking can be achieved independently from one pin to the other. Preferably, pins 14 are secured to gears 16 that cooperate with a gear ring linked to the locking ring of the main tube connection. Thus, the locking rotation of the ring causes rotation of the pins. Alternatively, gears 16 of pins 14 cooperate with a gear ring independent of the locking ring of the main tube connection. The rotation of the gear ring causes rotation of the pins so as to achieve simultaneously locking of the various pins.

Figure 4:
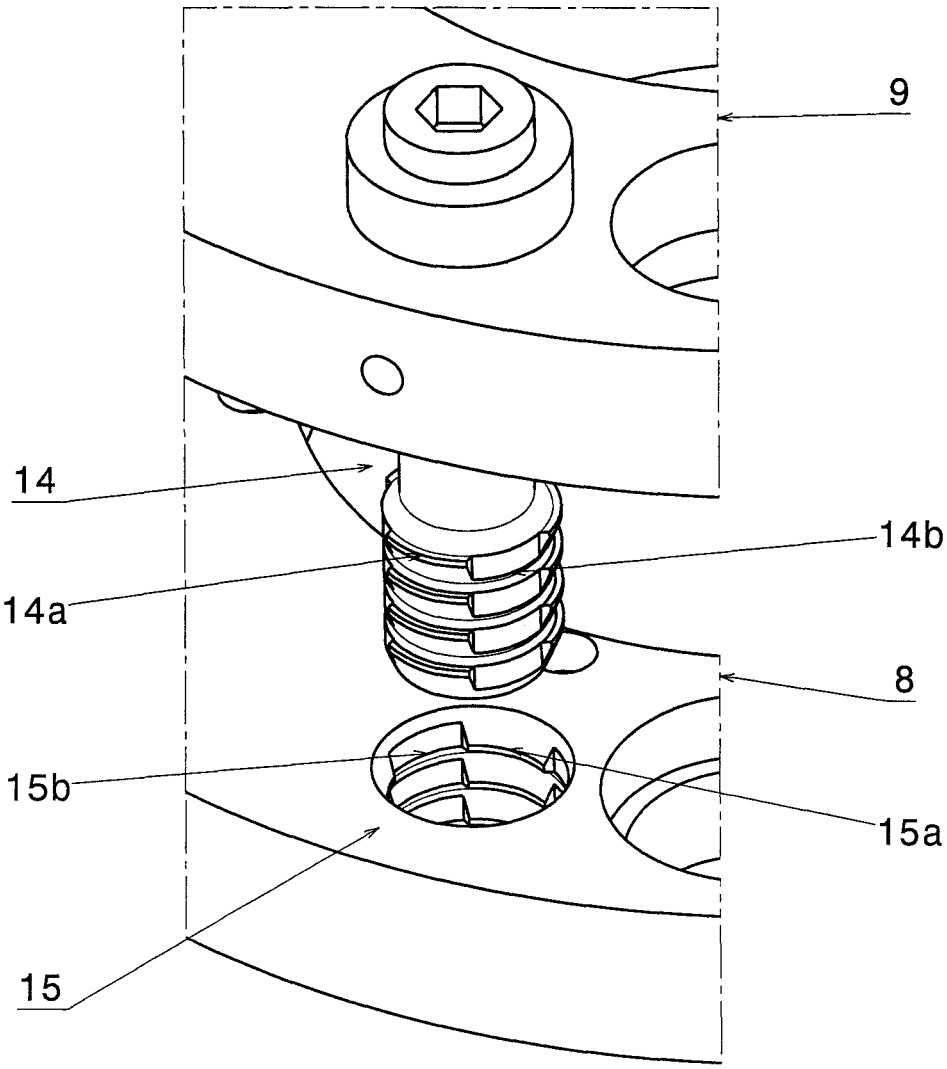
FIG. 4 shows in detail a pin and a bore making up a linking means according to the invention.

FIG. 1 shows two pins 14 parallel to the axis of auxiliary line 3, and arranged on either side of the linking means. FIG. 4 shows in detail a pin 14 positioned in an orifice provided in flange 9. Pin 14 consists of a rod provided with teeth 14*a* and hollows 14*b* that cooperate with teeth 15*a* and hollows 15*b* of bore 15 provided in flange 8. Teeth 14*a* and 15*a* extend along radial directions with respect to the axis of pin 14. Thus, once locked, the longitudinal stresses on the auxiliary line are evenly distributed in the vicinity of the connection while passing through the flanges.

Alternatively, pins 14 can be screws that cooperate with nuts so as to assemble flanges 8 and 9 in a bolted joint.

FIG. 1 also shows means 17 for adjusting the length of the auxiliary lines.

Figure 2:
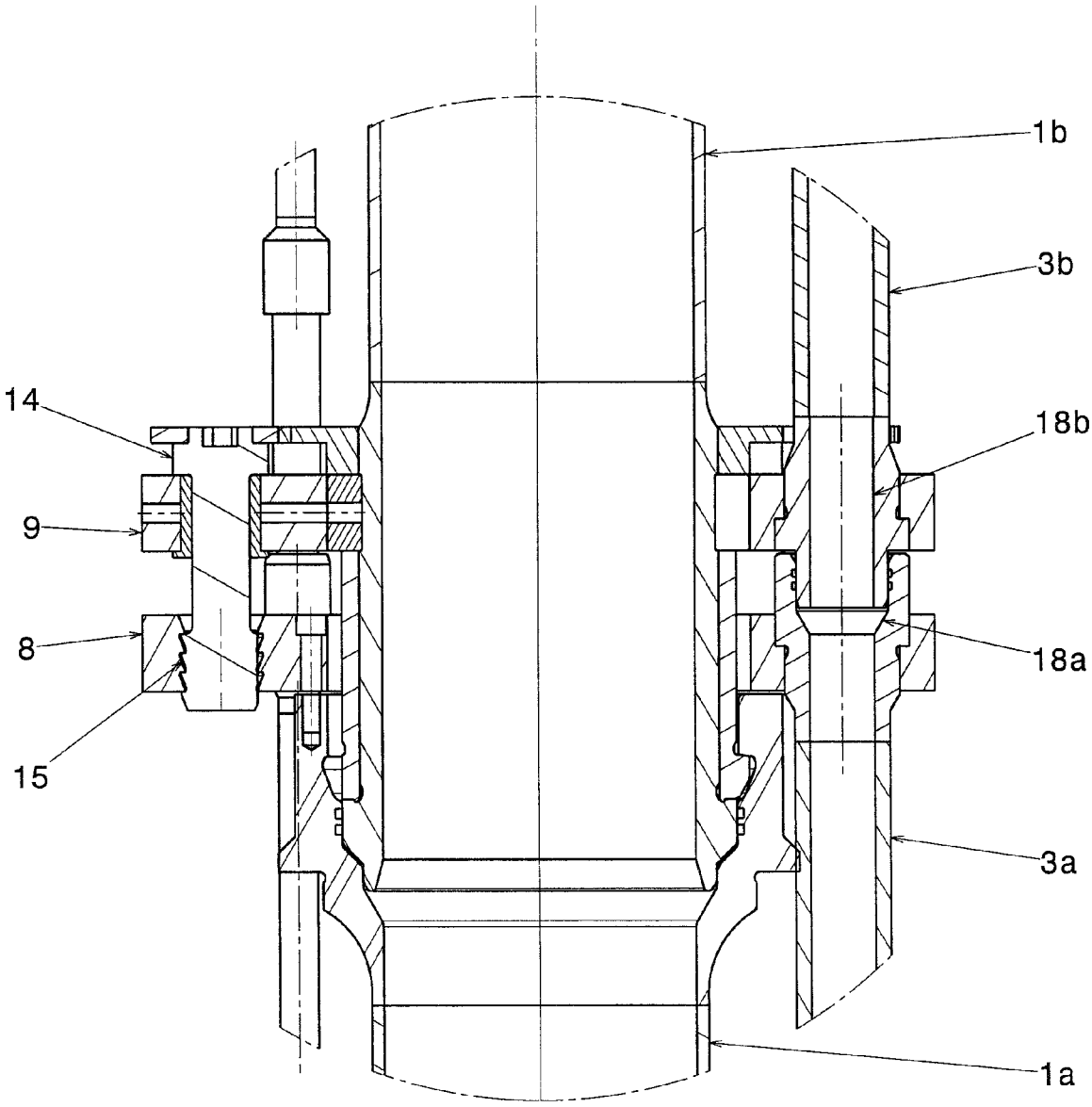
FIG. 2 shows, in longitudinal section, the connection means of a riser section and the linking means according to the invention, FIG. 3 diagrammatically shows a riser section equipped with linking means according to the invention.

FIG. 2 shows in longitudinal section the connection and linking means for two sections 1*a* and 1*b* forming a riser portion. Auxiliary lines 3*a* and 3*b* are connected by longitudinal interlocking connectors 18*a* (female) and 18*b* (male). Sealing gaskets provide sealing of this connection.

Flanges 8 and 9 hold the ends of the auxiliary lines in position and carry respectively bores 15 and pins 14 intended to secure the auxiliary lines, lines 3*a* and 3*b* for example. For example, as shown in FIG. 2, auxiliary lines 3*a* and 3*b* are respectively secured to flange 8 and 9 by axial shoulders provided in flanges 8 and 9.

Flange 8 is rigidly linked to the main tube or to an element of the main tube connector. Flange 9 can be mobile, within the limits of a predetermined play, with respect to the main tube in the direction of axis 4.

Thus, the auxiliary lines are assembled by the flanges and several pins, and they transmit the longitudinal stresses from one auxiliary line to the next.

Such an assembly affords significant advantages:

since the auxiliary line linking means are not concentric to the lines, the overall diameter thereof is smaller. Thus, the out-to-out diameter of the section is decreased, such a linking means design allows to best distribute the longitudinal stresses of the auxiliary lines circumferentially, machining the pins and the corresponding bores in form of teeth is done on parts of smaller size in relation to connections at the end of the lines, which makes it less expensive.

Figure 3:
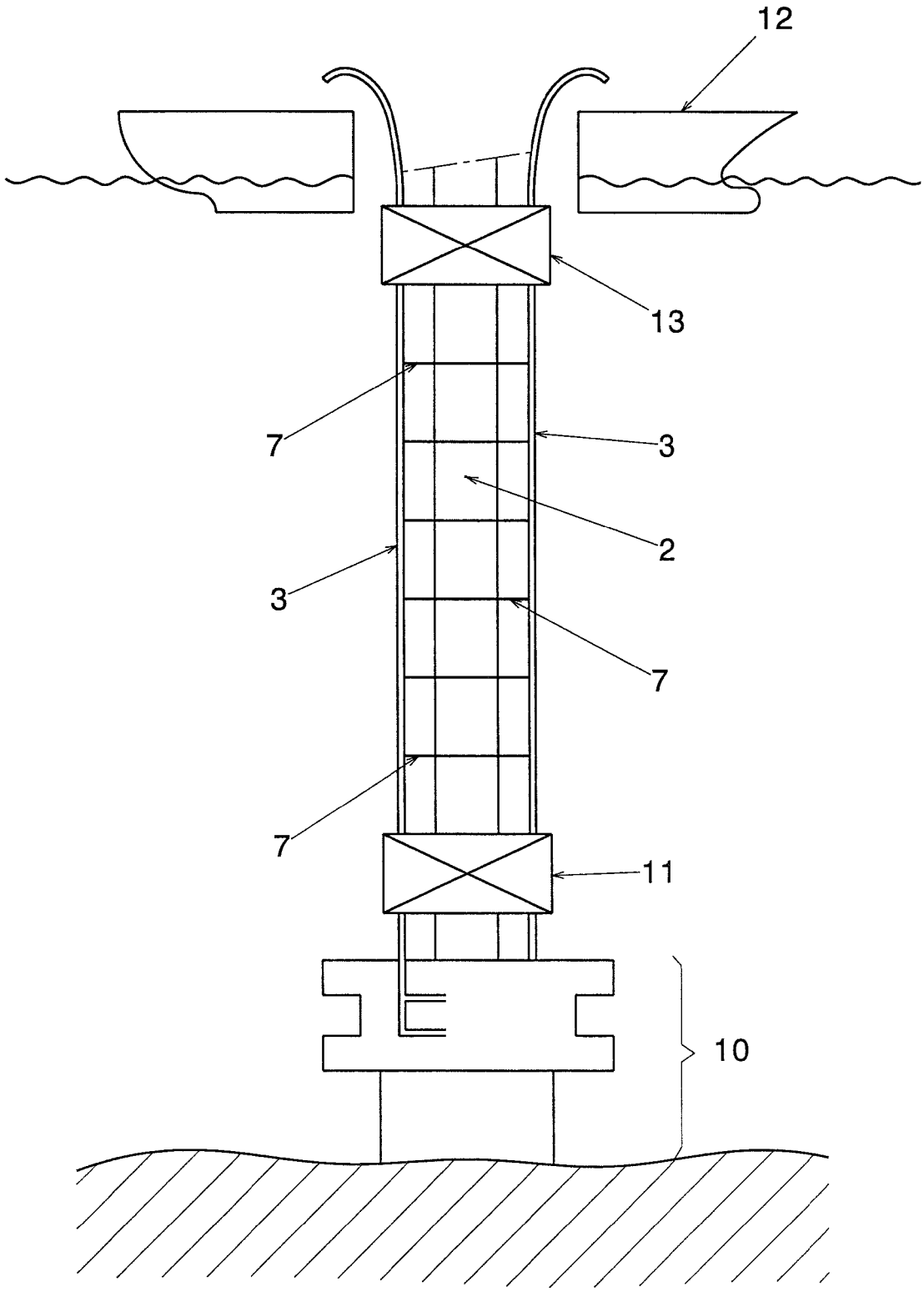

The riser diagrammatically shown in FIG. 3 comprises a main tube 2 and auxiliary lines 3. The main tube and each auxiliary line 3 are connected to wellhead 10 by a connector 11 and to floater 12 by another connector 13. Connectors 11 and 13 transmit the longitudinal stresses from the floater to the riser and from the latter to the wellhead. Thus, sections 1 allow to achieve a riser for which the main tube forms a mechanically rigid assembly that withstands the longitudinal stresses between wellhead 10 and floater 12. Furthermore, according to the invention, each auxiliary line forms separately a mechanically rigid assembly that also withstands the longitudinal stresses between wellhead 10 and floater 12. Consequently, the longitudinal stresses applied to the riser are distributed among main tube 2 and the various auxiliary lines 3.

Besides, at the level of section 1, each auxiliary line element 3 is secured to the main tube by fastening means 7. These fastening means 7 are suited to distribute or to balance the stresses between the various auxiliary lines and the main tube, notably if the deformations between the lines and the main tube are not equal, for example in case of a temperature variation between the different lines. Thus, the stresses, and notably the tensional stress, undergone by the riser are distributed among the auxiliary lines and the main tube over the entire height of the riser, by multiplying the number of said fastening means over this height.

By way of example, a riser according to the invention can have the following characteristics:

Main tube diameter: 21"

Auxiliary lines diameter: 6"

Operating pressure: 1050 bars

Tensional stresses exerted on the riser: 1000 tons.

Furthermore, in order to produce risers that can operate at depths reaching 3500 m and more, metallic tube elements are used, whose resistance is optimized by composite hoops made of fibers coated with a polymer matrix.

A tube hooping technique can be the technique consisting in winding under tension composite strips around a metallic tubular body, as described in documents FR-2,828,121, FR-2, 828,262 and U.S. Pat. No. 4,514,254.

The strips consist of fibers, glass, carbon or aramid fibers for example, the fibers being coated with a polymer matrix, thermoplastic or thermosetting, such as a polyamide.

A technique known as self-hooping can also be used, which consists in creating the hoop stress during hydraulic testing of the tube at a pressure causing the elastic limit in the metallic body to be exceeded. In other words, strips made of a composite material are wound around the tubular metallic body. During the winding operation, the strips induce no stress or only a very low stress in the metallic tube. Then a predetermined pressure is applied to the inside of the metallic body so that the metallic body deforms plastically. After return to a zero pressure, residual compressive stresses remain in the metallic body and tensile stresses remain in the composite strips.

The thickness of the composite material wound around the metallic tubular body, preferably made of steel, is determined according to the hoop prestress required for the tube to withstand, according to the state of the art, the pressure and tensional stresses.

According to another embodiment, tubes 3 that make up the auxiliary lines can be made of an aluminium alloy. For example, aluminium alloys with ASTM (American Standard for Testing and Material) references 1050, 1100, 2014, 2024, 3003, 5052, 6063, 6082, 5083, 5086, 6061, 6013, 7050, 7075, 7055 or aluminium alloys marketed under reference numbers C405, CU31, C555, CU92, C805, C855, C70H by the ALCOA Company can be used.

Alternatively, tubes 3 that make up the auxiliary lines can be made of a composite material consisting of fibers coated with a polymer matrix. The fibers can be carbon, glass or aramid fibers. The polymer matrix can be a thermoplastic material such as polyethylene, polyamide (notably PA11, PA6, PA6-6 or PA12), polyetheretherketone (PEEK) or polyvinylidene fluoride (PVDF). The polymer matrix can also be made of a thermosetting material such as epoxys.

Alternatively, tubes 3 that make up the auxiliary lines can be made of a titanium alloy. For example, a Ti-6-4 titanium alloy (alloy comprising, in wt. %, at least 85% titanium, about 6% aluminium and 4% vanadium) or the Ti-6-6-2 alloy comprising, in wt. %, about 6% aluminium, 6% vanadium, 2% tin and at least 80% titanium, can be used.

The invention claimed is:

1. A riser section comprising a main tube, at least one auxiliary line element arranged substantially parallel to the main tube, the ends of the main tube comprising connection means allowing longitudinal stresses to be transmitted, the ends of the at least one auxiliary line element comprising linking means allowing longitudinal stresses to be transmitted, characterized in that the linking means comprise at least one pin and at least one bore, the at least one pin being formed on a first end of the riser section and the at least one pin being configured to cooperate with at least one other bore on an end of an adjacent riser section to form a first assembly, the at least one bore being formed on a second end of the riser section and the at least one bore being configured to cooperate with at least one other pin on an end of another adjacent riser section to form a second assembly, and in that the axis of the at least one pin is parallel to the axis of the at least one auxiliary line element and non-merging, and wherein the pins are provided with teeth and hollows that cooperate with teeth and hollows of the bores.

2. A riser section as claimed in claim 1, comprising two flanges arranged at each end of the at least one auxiliary line element, wherein one flange of the two flanges carries the at least one pin, the other flange of the two flanges carries the at least one bore.

3. A riser section as claimed in claim 2, wherein the two flanges have the shape of a crown concentric to the main tube, of a crown portion or of a rectangular plate.

4. A riser section as claimed in claim 1, wherein the linking means comprise two pins arranged on either side of the at least one auxiliary line element on a circle centred on the axis of a riser.

5. A riser section as claimed in claim 2, wherein the at least one auxiliary line element is connected to the main tube by at least one of the two flanges.

6. A riser section as claimed in claim 1, wherein the connection means of the main tube comprise a bayonet locking system.

7. A riser section as claimed in claim 1, wherein pins of the at least one pin of the linking means comprise a rotating locking element and a synchronization means, and rotation of the synchronization means causes rotation of the locking element.

8. A riser section as claimed in claim 1, wherein the connection means comprise a first rotating locking element, wherein pins of the at least one pin of the linking means comprise a second rotating locking element, and rotation of the first locking element causes rotation of the second locking element.

9. A riser section as claimed in claim 1, wherein the main tube is a steel tube hooped by composite strips.

10. A riser section as claimed in claim 1, wherein the at least one auxiliary line element is a steel tube hooped by composite strips.

11. A riser section as claimed in claim 9, wherein the composite strips comprise glass, carbon or aramid fibers coated with a polymer matrix.

12. A riser section as claimed in claim 1, wherein the at least one auxiliary line element is made of a material selected from the group consisting of a composite material comprising reinforcing fibers coated with a polymer matrix, an aluminium alloy, and a titanium alloy.

13. A riser comprising at least two riser sections as claimed in claim 1, assembled end to end, wherein a first auxiliary line element of a first riser section of the at least two riser sections transmits longitudinal stresses to a second auxiliary line element of a second riser section of the at least two riser sections to which it is assembled by means of a first flange holding an end of the first auxiliary line element around a first main tube of the first riser section and a second flange holding an end of the second auxiliary line element around a second main tube of the second riser section, the first flange and the second flange being secured by pins arranged parallel to the first auxiliary line element and the second auxiliary line element.

14. A riser section as claimed in claim 10, wherein the composite strips comprise glass, carbon or aramid fibers coated with a polymer matrix.

15. A riser section as claimed in claim 1, wherein the teeth of the pins extend along radial directions with respect to axes of the pins.

16. A riser section comprising:

a main tube;

at least one auxiliary line element arranged substantially parallel to the main tube;

a locking system including at least one pin and at least one bore, axes of the at least one pin and the at least one bore being parallel to an axis of the at least one auxiliary line element, the axes of the at least one pin and the at least one bore non-merging with the axis of the at least one auxiliary line element, and wherein the locking system is configured to engage the at least one pin with other bores of other riser sections, the locking system is configured to engage the at least one bore with other pins of the other riser sections, and the pins are provided with teeth and hollows that cooperate with teeth and hollows of the bores.

17. The riser section as claimed in claim 16, further comprising two flanges connected to opposite ends of the main tube, and the two flanges holding the at least one auxiliary line element.

18. The riser section as claimed in claim 17, wherein the locking system is configured to engage the two flanges with other flanges of the other riser sections.

19. The riser section as claimed in claim 16, wherein the teeth of the pins extend along radial directions with respect to axes of the pins.

* * * * *